United States Patent [19]

Verzilli et al.

[11] Patent Number: 4,996,746

[45] Date of Patent: Mar. 5, 1991

[54] FLAT CLEANING APPARATUS FOR A CARD

[75] Inventors: Giuseppe Verzilli, Wiesendangen; Robert Demuth, Nuerensdorf, both of Switzerland

[73] Assignee: Rieter Machine Works, Ltd., Winterthur, Switzerland

[21] Appl. No.: 396,435

[22] Filed: Aug. 21, 1989

[30] Foreign Application Priority Data

Aug. 23, 1988 [DE] Fed. Rep. of Germany ..... 3828581
Oct. 10, 1988 [DE] Fed. Rep. of Germany ..... 3834452

[51] Int. Cl.[5] ..... D01G 15/78

[52] U.S. Cl. ..... 19/111; 19/110; 19/102

[58] Field of Search ..... 19/100, 102, 103, 104, 19/108, 109, 110, 111

[56] References Cited

U.S. PATENT DOCUMENTS

| | | | |
|---|---|---|---|
| 624,861 | 5/1899 | Philipson | 19/111 |
| 878,884 | 2/1908 | Kip et al. | 19/102 |
| 1,272,045 | 7/1918 | Hurst | 19/109 |
| 1,311,293 | 7/1919 | Schaefer | 19/109 |
| 1,635,834 | 7/1927 | Goldsmith | 19/109 |
| 2,433,810 | 12/1947 | Clark | 19/109 |
| 2,541,407 | 2/1951 | Clark | 19/109 |
| 2,929,113 | 3/1960 | Hess | 19/111 |
| 3,321,810 | 5/1967 | Burnham | 19/109 |
| 4,126,915 | 11/1978 | Zieg et al. | 19/109 |
| 4,353,149 | 10/1982 | Demuth et al. | 19/107 |
| 4,759,102 | 7/1988 | Verzilli et al. | 19/111 |
| 4,771,514 | 9/1988 | Verzilli | 19/109 |

FOREIGN PATENT DOCUMENTS

| | | |
|---|---|---|
| 0249771 | 12/1987 | European Pat. Off. . |
| 0381999 | 9/1923 | Fed. Rep. of Germany . |
| 1292552 | 4/1969 | Fed. Rep. of Germany . |
| 1903477 | 8/1970 | Fed. Rep. of Germany . |
| 2164108 | 6/1973 | Fed. Rep. of Germany . |
| 2361315 | 6/1975 | Fed. Rep. of Germany . |
| 2926261 | 1/1981 | Fed. Rep. of Germany . |
| 13772 | 8/1970 | Japan . |
| 0501069 | 2/1971 | Switzerland . |
| 18497 | of 1889 | United Kingdom . |
| 23533 | of 1896 | United Kingdom . |
| 0142229 | 5/1920 | United Kingdom . |

*Primary Examiner*—Werner H. Schroeder
*Assistant Examiner*—Michael A. Neas
*Attorney, Agent, or Firm*—Kenyon & Kenyon

[57] ABSTRACT

The flat cleaning apparatus employs a comb for loosening fibers and dirt particles carried by the revolving flats of the revolving flat clothing. In addition, a casing which travels across the width of the revolving system has a suction nozzle for drawing up the loosened strips of fibers and dirt particles. In addition, a brush is provided downstream of the suction nozzle which is movable relative to the flats to clean between the flats so as to release deep-seated dirt after the strips are removed. The brush is mounted in a chamber which communicates with the suction nozzle so that a suction force is available for removing the deep-seated dirt brought up by the brush.

39 Claims, 6 Drawing Sheets

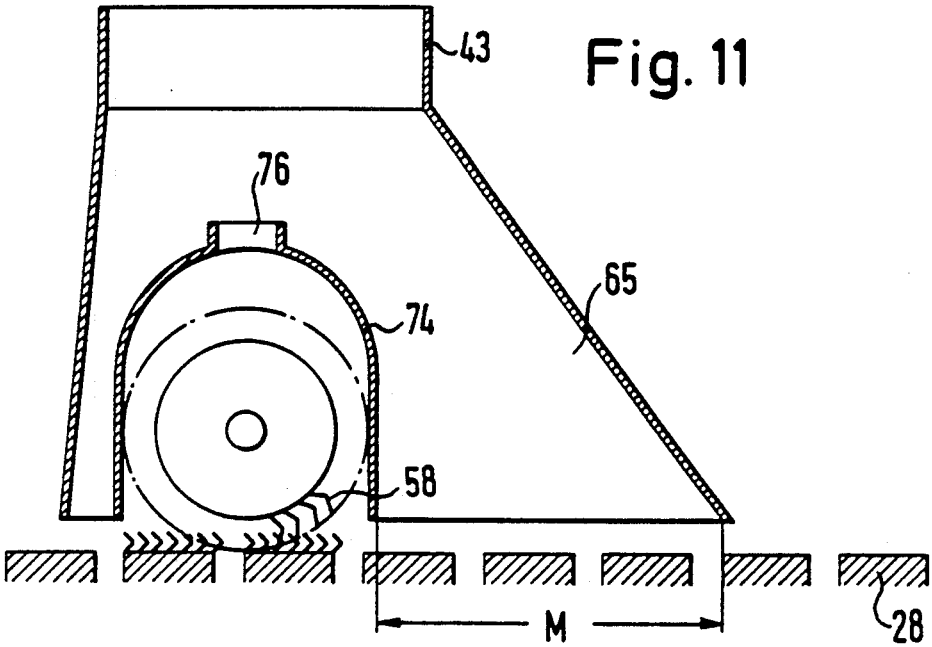
Fig. 11
Fig. 12
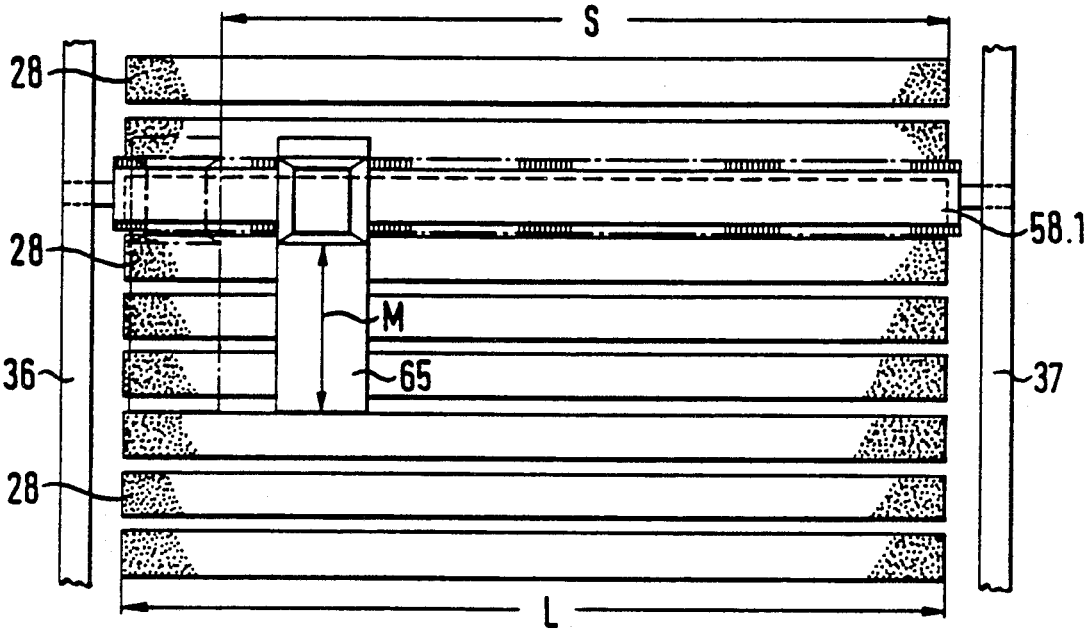
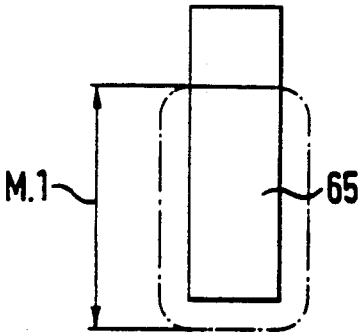
Fig. 13

FLAT CLEANING APPARATUS FOR A CARD

This invention relates to a flat cleaning apparatus for a card.

Heretofore, various types of cleaning devices have been known for cleaning the revolving flats of a card. In some cases, the cleaning devices have included a comb for first loosening strips comprised of fibers and dirt particles which are carried by the revolving flats or the tips of the revolving flat clothing as well as a suction-extraction means for thereafter drawing off the loosened strips. Cleaning devices of this kind have been in practical use for some years and have given good results.

However, cotton flocks are increasingly harvested by machinery. As such, the cotton flocks are becoming increasingly contaminated by dirt and other particles. In spite of all efforts, it has not been possible to remove all the dirt from the flocks before delivery to a card. Even in the card region, impurities occur in the cotton flocks or in the open fibers and have to be removed therefrom. The increasing contamination of cotton flocks also increases the importance of removing dirt in the card, particularly around the revolving flats, since it is always necessary to prevent dirt which has once been separated from returning to the neighborhood of the swift of the card particularly in revolving flat systems.

Accordingly, it is an object of the invention to clean the revolving flats of a revolving flat system very efficiently but without a need to increase a suction-extraction power.

It is another object in the invention to provide a flat cleaning apparatus which is of relatively simple, reliable and economic construction.

Briefly, the invention provides a flat cleaning apparatus for a card which comprises a comb for loosening waste fiber and dirt on the flats of a revolving flat system, a suction-extraction means downstream of the comb for movement longitudinally across the flats and including at least one suction nozzle for drawing-in loosened waste fiber from the flats and a rotatable brush in communication with the suction nozzle for extracting deep-seated dirt from between the flats.

During operation, the suction-extraction means is able to move along the flats in order to suck off successive regions of the loosened strips. The suction-extraction means also applies suction to the brush in order to draw off the deep seated dirt cleaned out by the brush. In this respect, the brush is movable relative to the flat so that, after a dirt strip has been extracted by suction the brush is able to dip into the flat clothing and release deep-seated dirt. The suction flow from the suction-extraction means also removes the deep-seated dirt.

Due to the use of a travelling suction-extraction means, the suction power is always concentrated on a small region of the flats, so that only a reasonable amount of power is needed for suction-extraction. Since the revolving flats rotate relatively slowly, there is sufficient time to clean the entire length of each flat during movement under the suction-extraction means, which preferably moves transversely to the direction of motion of the flats. Deep-seated dirt loosened by the brush is also removed by the stream from the suction-extraction means, and consequently the additional deep cleaning by the brush does not appreciably increase the required suction-extraction power.

The cleaning apparatus can be constructed so that the suction-extraction means and the brush move along the flat or so that the brush is rotatably mounted on a longitudinal axis to extend over the entire flat length. In this case, only successive regions are subjected to suction during the travel of the suction-extraction means.

A preferred embodiment is characterized in that the suction-extraction means comprises a casing divided by a partition into a suction-extraction nozzle for sucking successive regions of the loosened strips and a suction-extracted chamber which at least partly covers the brush.

As a result of the partition, dirt loosened by the brush is not introduced into the suction stream removing the strips until the strips have been completely picked up by the stream. This prevents the airstream for removing dirt from the brush from having an adverse effect on the suction stream for the strips.

The suction-extracted chamber containing the brush is preferably disposed on the side of the partition remote from the comb. In this manner, deep cleaning occurs only after the strip has been loosened. This also prevents the strips themselves from clogging the brush with fibers.

Alternatively, a chamber containing the brush can be disposed next to the suction-extraction nozzle. This is particularly preferred when the flats themselves are relatively narrow. In this embodiment, the risk of brush clogging can be avoided without difficulty, since the travelling suction-extraction means cleans only when moving in a transverse direction across the card and the brush, considered in the direction of cleaning, is used after the suction nozzle, i.e. deep cleaning is carried out only after strips have been extracted by suction.

According to a particularly preferred embodiment, the brush is movable towards and away from the revolving flat. This up and down movement of the brush results in additional cleaning, so that the total cleaning effect can be very efficient.

The brush need not be constantly in operation. For example, the brush may be used only during every tenth revolution of the travelling flats. This method of operation is particularly practicable for a brush which moves up and down, since the brush can then be raised to avoid reaching the tips of the flat clothing at times when the brush is not being cleaned. This reduces the wear on the brush and flat clothing, i.e. the flat clothing is more gently treated.

Preferably, a chamber containing the brush has side walls which extend to near the bristle tips of the brush and, at the place at least substantially most remote from the flats, narrow to communicate with a suction nozzle which opens into the suction flow. In this manner, the dirt loosened by the brush tips and the air conveyed by these tips is efficiently conveyed to the suction nozzle and can then be efficiently removed. The suction nozzle which communicates with the side walls also increases the local air speed, so that dirt removal is particularly efficient at this place.

Preferably, the brush is drivable by a motor, more particularly, pneumatic or electric motor, carried by the travelling part of the suction-extraction means. In this manner, the brush drive can be very light and economic to manufacture, avoiding the need for complicated drive transmission elements. The brush can also easily be stopped by switching off the motor, e.g. if the revolving flats are deep-cleaned only periodically.

As an alternative, the brush may be disposed on a rotatable shaft extending over the entire width of the card, i.e. the entire length of the revolving flats, and drivable by a motor mounted on the card frame. This system is particularly advantageous when the shaft is also used for the travel of the suction-extraction means. In this system, a transmission is used either to increase the speed of rotation of the brush relative to the shaft or to reduce the speed of travel of the suction-extraction means.

Advantageously, the travelling suction-extraction means mounts the brush via axial bearings, and the brush travels with the suction-extraction means.

Preferably, the comb itself is mounted on a pivot and can be oscillated. The pivoting motion raises the strips from the flat clothing, so that they are only held loosely thereby and can easily be subjected to suction, i.e. less suction power is needed.

According to a particularly preferred embodiment, the comb can be raised and lowered on the pivot. In this manner, the comb can initially dip deeply into the clothing in order to loosen strips and any other dirt. At the end of the pivoting motion, the comb is then raised, so that during the return pivoting motion, the comb just touches the flat clothing, which consequently cleans the comb itself.

The shaft driving the brush or the travelling suction-extraction means can also be used for guiding the suction-extraction means during travel. By this means, the shaft is also used for another purpose, resulting in an economic and compact device.

As already mentioned, the brush may be mounted for rotation around a longitudinal axis to extend over the entire length of the flats. Preferably, the brush comprises one or more brush strips extending in a helix around their center of rotation so that regions without bristles are present between adjacent turns of the brush strip or of the individual strips. Tests have shown that a system employing this type of brush is very efficient, since loosened fibers and dirt tend to migrate to the areas free of bristles, from where they can easily be extracted by suction. The areas free from bristles also improve the discharge of the removed dirt particles and fibers.

This is particularly the case if a card clothing is provided on the travelling suction-extraction means, and the tips of the clothing extend into the bristles of the brush and comb out fibers or accumulations of fibers carried by the bristles. At the moment when the combed-out fibers come to an empty zone and are no longer retained by the rotating brush, they are sucked away by the air stream, thus keeping both the brush and the card clothing clean.

The brush drive can be relatively low-powered, since only one region of the brush is in combing engagement with a flat at one time.

These and other objects and advantages of the invention will become more apparent from the following detailed description taken in conjunction with the accompanying drawings wherein:

FIG. 1 diagrammatically illustrates a side view of a card comprising a cleaning means according to the invention;

Figure 2:
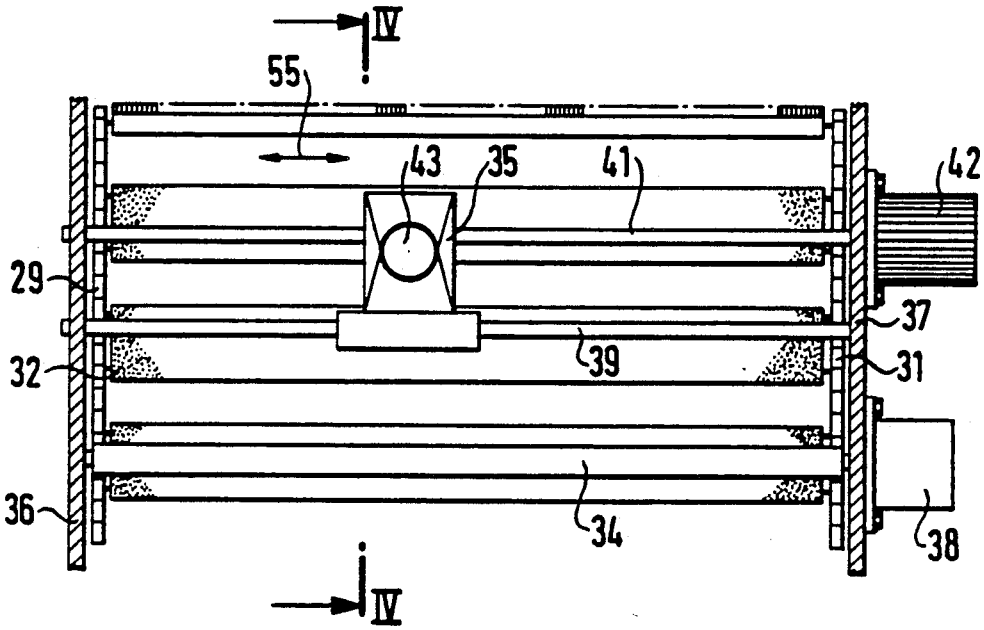
FIG. 2 illustrates a view taken on line II—II of FIG. 1 showing only a part of the revolving-flat system of the card and on a larger scale than in FIG. 1.
Figure 8:
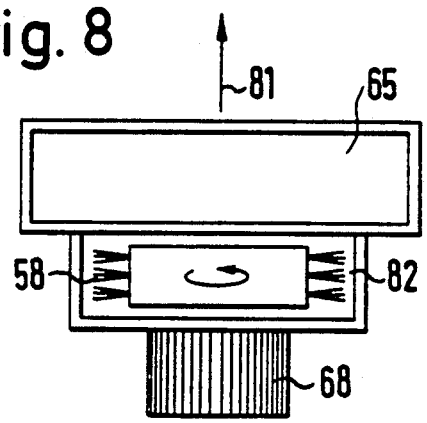
FIG. 8 is a view corresponding to FIG. 5 showing another embodiment according to the invention.
Figure 7:
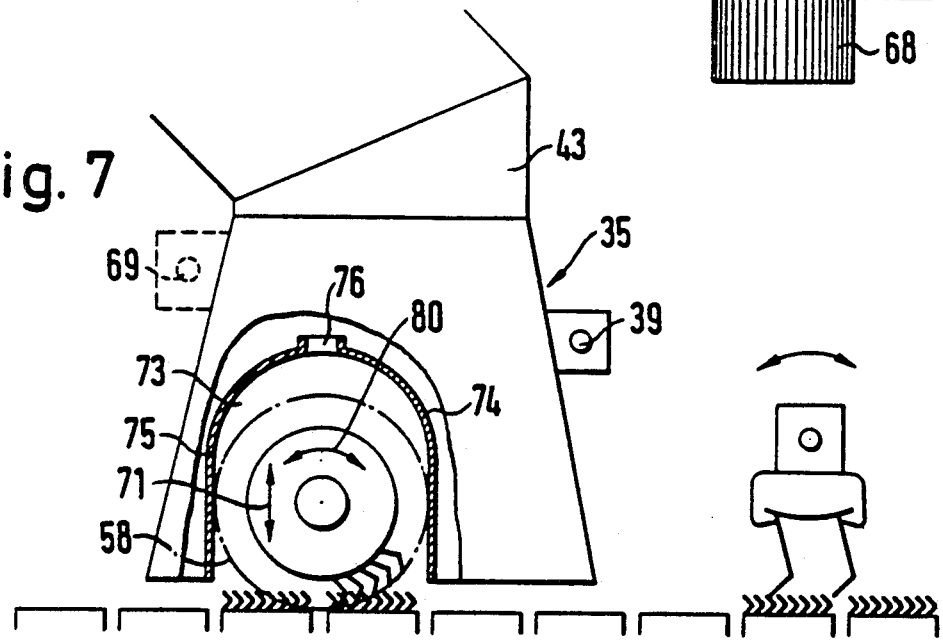
FIG. 7 is another side view of a variant of the cleaning apparatus according to the invention.
Figure 8A:
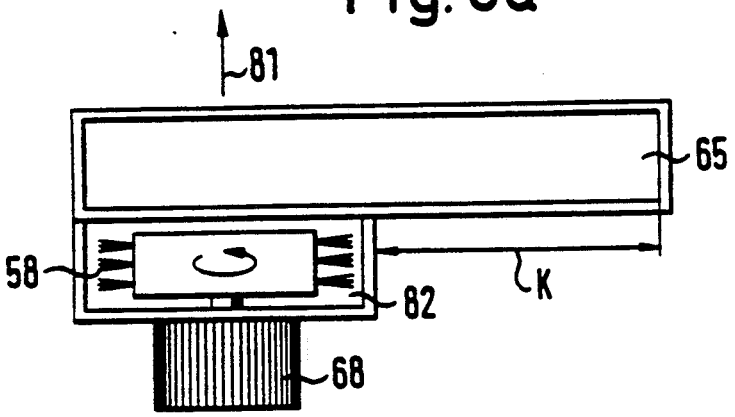
Figure 9:
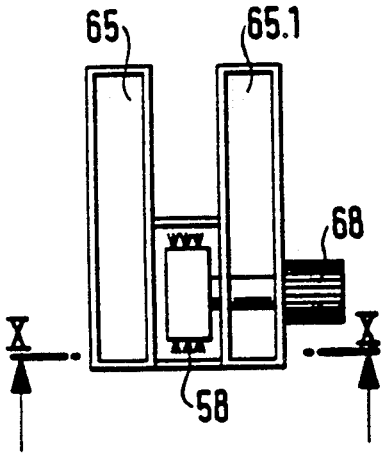
Figure 10:
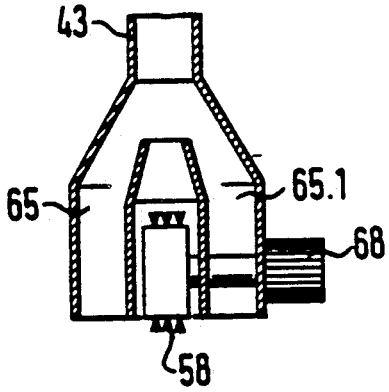
Figure 14:
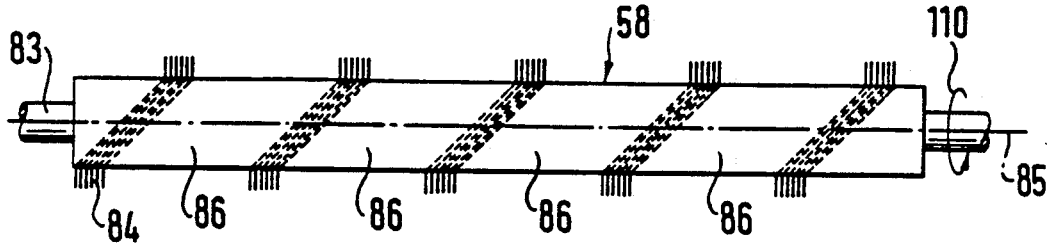
Figure 15:
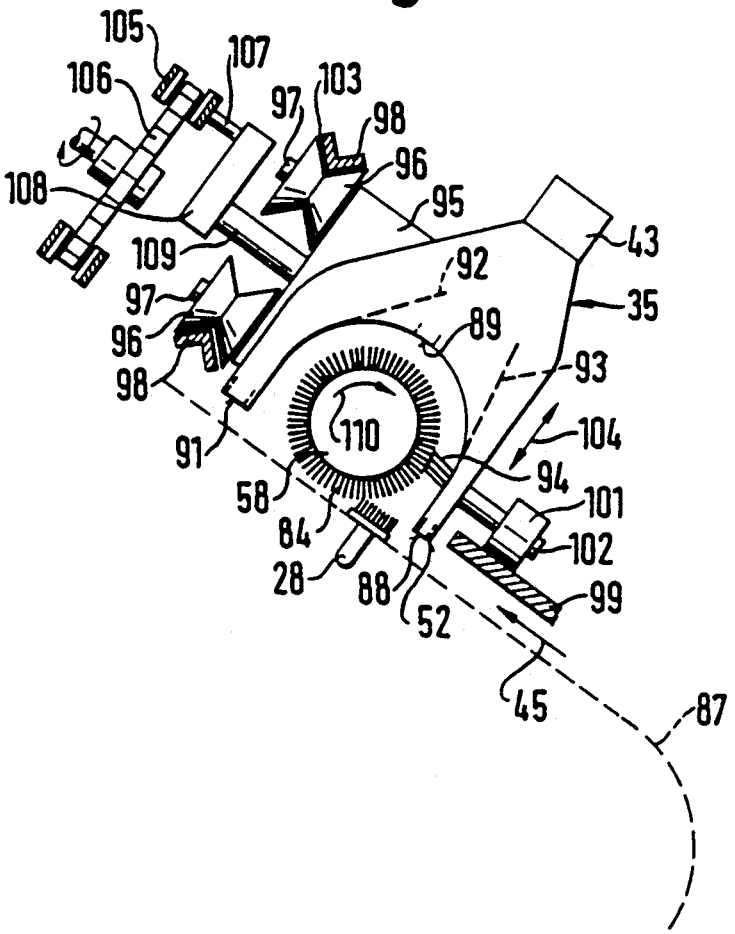

FIG. 8*a* illustrates a variant of the device in FIG. 8*a*;

FIG. 9 illustrates a variant of the device in FIG. 8*a*;

FIG. 10 illustrates a view taken on line X—X of FIG. 9;

FIG. 11 shows further details of the device in FIG. 7;

FIG. 12 shows a variant of the device in FIG. 2;

FIG. 13 shows a detail of the device in FIG. 12;

FIG. 14 illustrates a plan view of a brush for use with a cleaning apparatus according to the invention, and FIG. 15 illustrates a side view of a suction-extraction means for co-operation with the brush in FIG.

Figure 1:
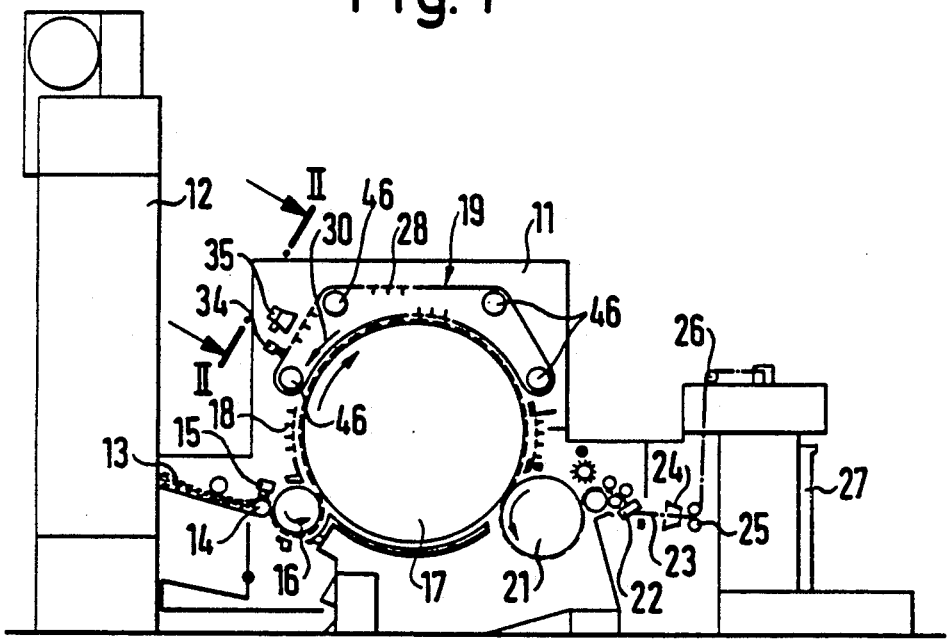

Referring to FIG. 1, the card 11 is supplied with flocks which come from a flock feed 12 in the form of a lap 13 which is fed between a feed roller 14 and a feed plate 15 and taken over in the form of individual cotton fibers by a licker-in 16. The cotton fibers are delivered by the licker-in 16 to a swift 17 and initially move past stationary flats 18 until arriving near a "revolving-flat" system 19.

After leaving the revolving-flat system 19, the combed-out cotton fibers are taken over by a doffer 21 and compressed by a transverse conveyor 22 to form a sliver 23 which then travels through a hopper 24, measuring rollers 25 and a guide roller 26 and is deposited in a can 27.

The revolving-flat system 19 comprises individual flats 28 which, as also shown in FIG. 2, are supported at their ends by respective chains 29, 31 and rotate in the direction indicated by the arrow 30 (FIG. 1). Each flat 28 has a clothing of fine wires, shown only in parts at 32 in FIG. 2. In the bottom run of the rotating system, the spikes of the clothing extend downwards towards the swift 17 which carries a similar spiked clothing, so that in the top run, the spiked clothing points outwards and upwards. As a result of the combing effect between the flats 28 and the swift 17, some fibers together with impurities are taken up by the spiked clothing of the revolving flats. The accumulation of fibers on the flats form "strips" which have to be removed from the flats. This purpose is served by a comb 34 and suction-extraction means 35.

As FIG. 2 shows, a comb 34 extends over the entire length of the revolving flats and is mounted at both ends in journals in side plates 36, 37 of the card frame. The comb 34 is driven in reciprocation by a motor and transmission system 38, which will be explained in detail hereinafter. Alternatively, the comb 34 can be moved up and down, as also to be explained in detail hereinafter. As FIG. 2 shows, a suction-extraction means 35 is mounted downstream of the comb 34 relative to the direction of movement of the flats 28 on two guide rods 39, 41, rod 41 also being designed as a shaft which can be driven by a motor 42. The shaft 41 drives the suction-extraction means 35 in reciprocation along the guide rod 39 or the shaft 41. The motion is brought about by a transmission (not shown) which moves with the suction-extraction means 35.

The suction-extraction means 35 is connected to a suction source via a spigot 43 and a flexible tube (not shown). The flexible tube is designed to permit the suction-extraction means to move in reciprocation as required between the two side plates 36 and 37, and provides a sufficiently strong suction stream in all intermediate positions between the two side walls.

Figure 3:
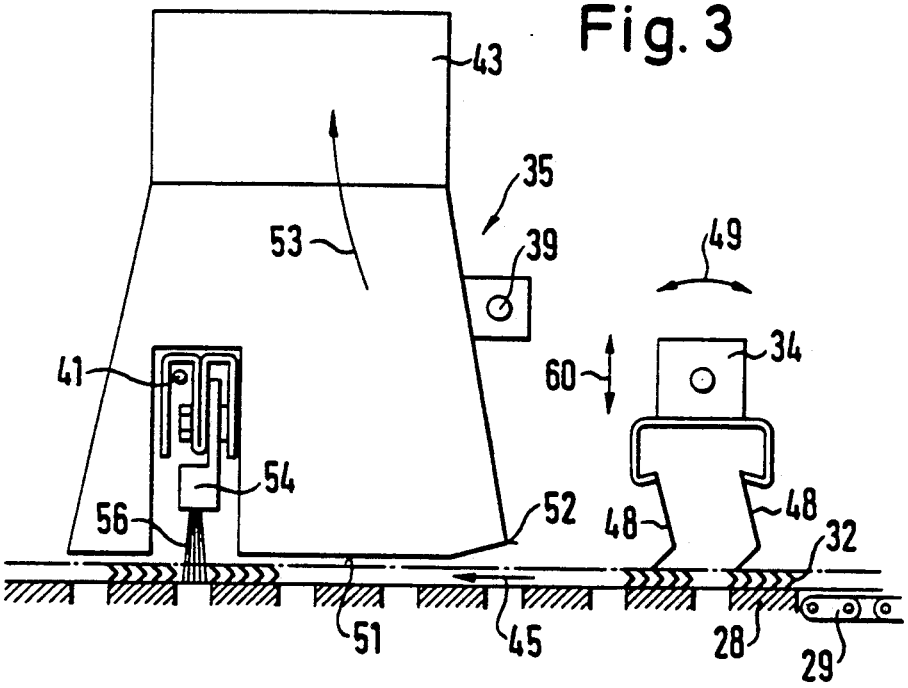
FIG. 3 illustrates a side view of a first embodiment of a cleaning apparatus according to the invention viewed along IV—IV in FIG. 2, but not showing the embodiment in FIG. 2.

Referring to FIG. 3, the flats 28 move in the direction indicated by the arrow 45, the movement being brought about by the rotating chains 29. Besides being moved in the direction of arrow 45 by the chain drive, the flats 28 are pivotably mounted relative to one another, so that they can be moved round various guide rollers 46 (see FIG. 1) in the revolving-flat system 19.

The comb 34 has downwardly extending spikes 48 which due to the reciprocating motion of the comb 34 indicated by the double arrow 49, are capable of loosening strips of waste fiber and dirt, from the revolving flats 28. After being loosened, the strips are conveyed on the tips of the spikes 32 towards the suction-extraction means 35. The suction-extraction means 35 is in the form of a casing which tapers somewhat towards the spigot 43 and is open at the underside 51, so that the underside forms an opening through which air is drawn in. As soon as the strips have arrived near the front edge 52 of the suction opening of the casing 35, they are engaged by the suction stream and completely released from the revolving flats 28 and removed in the air flow through the spigot 43, as diagrammatically indicated by arrow 53.

A brush 54 is secured to the rear region of the suction-extraction means 35, so that the brush 54 and the suction-extraction means 35 are moved along the revolving flat in the direction indicated by the double arrow 55 in FIG. 2. In the process, the bristles (e.g. wire bristles) 56 of the brush 54 engage in the spiked clothing of the revolving flats and loosen the deep-seated dirt. This also occurs at the open underside 51 of the suction-extraction means 35, and consequently the loosened deep-seated dirt particles and fibers are also engaged by the air flow into the suction-extraction means 35 and are discharged by the air flowing through spigot 43.

In the present example, the brush 54 is on rails and extends down to the base of the clothing and is secured to bearing plates of the casing. The dirt is loosened and extracted by suction from the base of the flats both by the motion of the flats and also by the motion of the suction-extraction means 35 along the flats 28.

The comb 34 can also be moved up and down in the direction of the double arrow 60. This movement, coupled with the pivoting motion along the double arrow 49, is brought about by gear 38 as follows: The comb 34 first dips deeply into the clothing, is pivoted forward in the direction of arrow 45, is raised (either during or after the pivoting motion) and is then moved back. When the tips of the wire teeth or spikes on the comb 34 move along the tips of the spikes on the flat clothing 32, the spikes of the comb 34 are consequently cleaned thereby. At the end of the return stripping motion, the comb 34 is back in its starting position and the combined reciprocation and the combined pivoting and upward and downward movement can be repeated.

Figure 4:
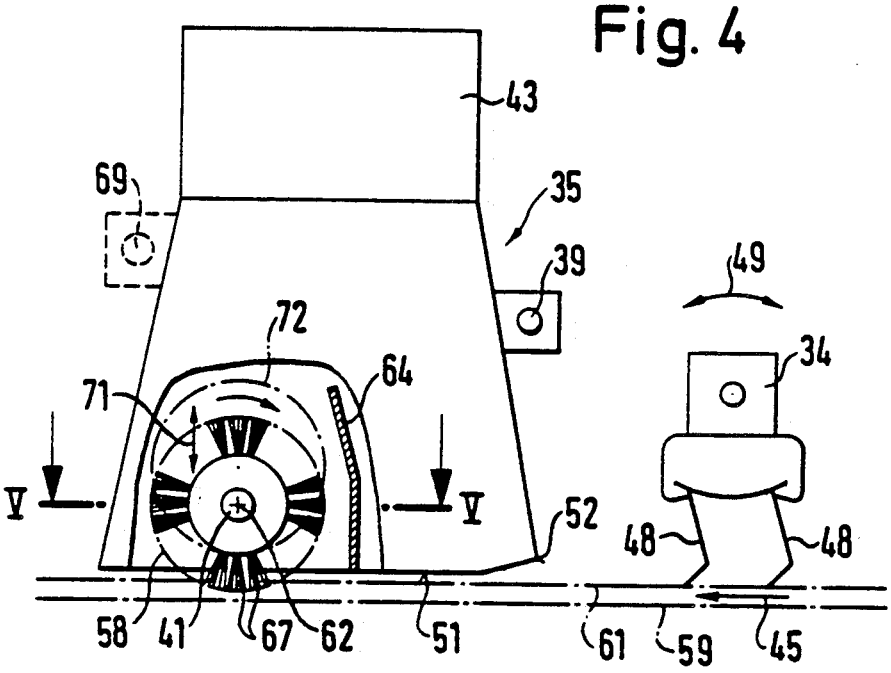
FIG. 4 is a side view corresponding to the side view in FIG. 3 but of the embodiment shown in FIG. 2.

Referring to FIG. 4 wherein like reference characters indicate like parts as above, use may be made of a rotatable brush 58. For simplicity, the individual revolving flats are not shown. Instead, the position of the base of the flat clothing and the tips of the spikes thereon are indicated by two chain-dotted lines 59 and 61 only. In this embodiment, the brush 58 is rotatable around an axis 62 and is directly driven by the shaft 41. The brush 58 is disposed in a chamber 63 which at its front end, looking in the direction of arrow 45, is bounded by a partition 64 of the suction means 35. The partition 64, together with the front 52 of the suction-extraction means 35, constitutes a front suction nozzle 65 (see FIG. 5) on the underside of the suction-extraction means 35, used as before, for sucking away the loosened strips. The partition 64 also produces an air flow upwards through the chamber 63, which entrains the dirt particles loosened by the bristles 67 of the brush 58 and, as previously described, feeds them into the air flow through the spigot 43, so that these dirt particles are also removed by the suction-extraction means 35.

It is not absolutely essential for the brush 58 to be driven by the shaft 41. The brush 58 can equally well be driven by a separate motor mounted on the casing of the suction-extraction means 35 as diagrammatically shown in FIG. 5 at 68. In this case, the shaft 41 is disposed outside the casing of the suction-extraction means 35, as diagrammatically indicated at 69 in FIG. 4.

FIG. 4 shows another variant in which the brush 58 is not only rotatable but is also movable up and down as indicated by the double arrow 71, the topmost position of the brush being marked 72. When the brush 58 is raised, the bristles 67 are brought out of engagement with the flat clothing, so that the cleaning bristles are temporarily inactivated. The forced upward and downward movement of the bristles during the brush movement may also improve the cleaning.

Although not shown in the embodiment in FIG. 4, the comb 34 can also be driven upwards and downwards in the direction of the double arrow in the embodiment in FIG. 3.

Figure 5:
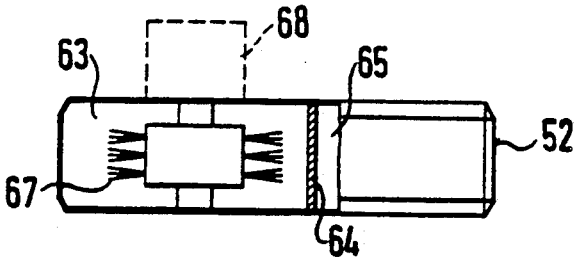
FIG. 5 illustrates a view taken on line V—V of FIG. 4.
Figure 6:
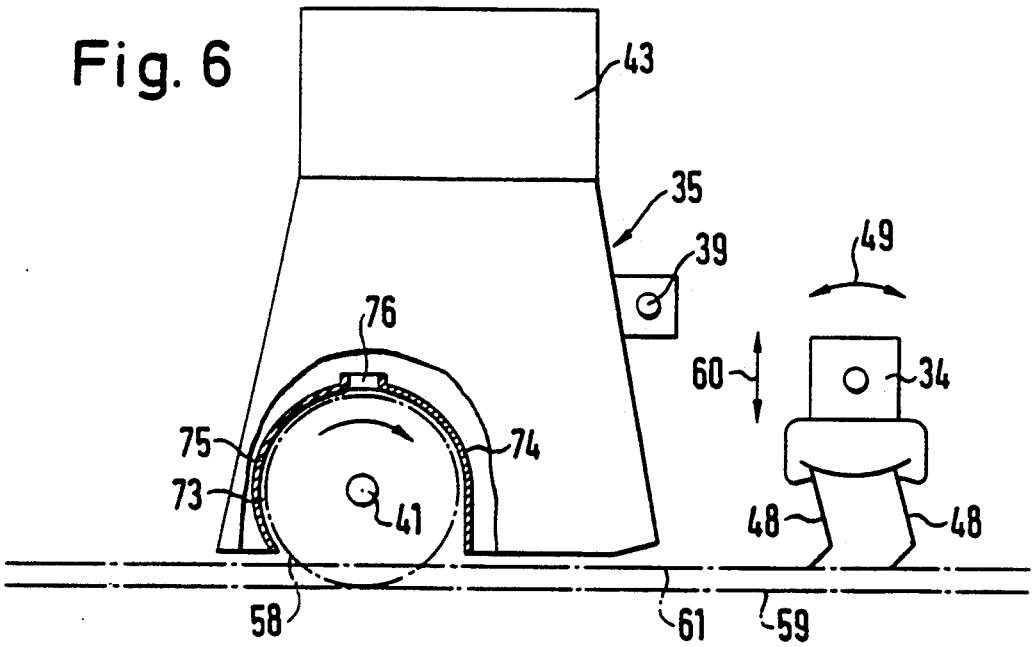
FIG. 6 is a side view of another embodiment of a cleaning apparatus according to the invention.

FIG. 6 shows an embodiment very similar to FIGS. 4 and 5 except that brush 58 is disposed inside a substantially cylindrical chamber 73 of the suction-extraction means 35 formed by a front wall 74 on the front side and a rear wall 75 at the back. The front wall 74 serves the same purpose as the partition 64 in the embodiment in FIG. 4 and, in co-operation with the rear wall 75 and the side walls of the suction-extraction means 35, forms a suction nozzle 76 above the brush 58 and through which the dirt loosened from the brush is discharged. Since the brush 58 is surrounded relatively closely by the front and rear walls 74 and 75, the centrifugal force of the brush 58 is used to accelerate the entrained dirt particles through the suction nozzle 76, so that the centrifugal force reinforces the suction force.

FIG. 7 shows an embodiment similar to FIG. 6 except that the front and side walls 74, 75 of the chamber 73 for the rotating brush 58 are constructed so that the brush 58 can move up and down as indicated by the arrow 71 corresponding to the up and down movement described in conjunction with the embodiment in FIG. 4. As also shown by the example in FIG. 7, the direction of rotation of the brush 58 can be changed over in this case. This may be advantageous particularly when the brush 58 tends to become dirty itself, since the change-over movement of the flat clothing can have a cleaning effect on the bristles of the brush 58. When the rotation of the brush 58 is again changed over, the loosened dirt can again be removed through the nozzle 76. In this example also, the comb 34 can move up and down.

In all the examples, the ends of the brush chamber, i.e. the sides parallel to the ends of the rotatable brushes, may alternatively be closed by continuous walls, as is normally the case. In other words, the side walls of the casing of the suction-extraction means 35 extend continuously up to the underside 51, so that the suction power is concentrated nearer the brush.

FIG. 8, in cross-section corresponding to FIG. 5, shows that the brush 58 can be disposed next to the suction opening 65 for sucking away the respective strip. This construction is specially recommended when the suction-extraction means is designed so that the brush 58 is used for deep cleaning only when the suction-extraction means is moving in the direction of arrow 81. It should be noted here that a rotating brush system need not rotate at high speed; the dirt is loosened by relatively slow rotation of the bristles, e.g. in the range from 80 to 120 rpm.

FIG. 8*a* shows a variant of the suction-extraction device in FIG. 8, where the suction opening 65 is prolonged on one side by a predetermined amount (K), in the direction of the comb 34. The advantage of this prolongation is that suction nozzle 65 engages with the flat 28 moving towards the nozzle 65 sooner than in the embodiment of FIG. 8.

FIG. 9 shows a variant of the suction nozzle in FIG. 8*a*, where a nozzle 65.1 parallel to the nozzle 65 in FIG. 8*a* is disposed on the other side of the brush 58, i.e. there is a double suction nozzle with the brush therebetween. As before, the brush 58 is driven by a motor 68, the only difference from the structure in FIG. 8*a* being that the motor shaft supporting the brush 58 extends through the suction-extraction nozzle 65.1. As indicated in FIG. 10, suction is exerted not only through nozzles 65 and 65.1 but also on the chamber containing the brush 58. As previously described, the spigot 43 is connected to a negative-pressure source.

Referring to FIG. 12, in order to ensure that no strips on a flat 28 reach the brush 58 or 58.1, the opening length (M) of the suction-extraction nozzle 65 in the direction of the comb must be made large enough to ensure that, corresponding to the speed of the suction-extraction means along the length of travel (S) and the speed of movement of the flats 28, the nozzle 65 can be moved over the length of travel (S) (i.e. between its two end positions) before a part of a flat which has not yet been cleaned reaches the brush 58 or 58.1.

In FIG. 12, the brush 58.1, in contrast to the brushes 58 shown hitherto, has a length substantially equal to or greater than the length (L) of the flats. The required extra length may be just a few millimeters, to ensure that the entire length of the flats 28 is covered by the cleaning action of the brush.

For simplicity, FIGS. 11 and 12 do not show all the reference numbers, but of course the opening length (M) applies to all the previous variants whether the brush is disposed in or inside the nozzle or between the nozzles, or whether the brushes are short or long.

In FIG. 13, a broken line indicates that the length (M) of the nozzle 65 in FIG. 12 can be made somewhat shorter if the suction effect extends beyond the nozzle 65 into the broken-line region. This variant, however, requires a larger amount of air or a higher air speed to have enough energy to extract strips by suction outside the nozzle.

Referring to FIG. 14, a brush 58 may be mounted to rotate with and on a shaft 83 rotatable in the direction indicated by the arrow 110. In this example, the brush 58 comprises an individual strip 84 of bristles extending in a helix around the longitudinal axis 85 of the brush 58 or shaft 83. In this example, the brush 58 has a length at least equal to the length (L) of the flats, which are not shown in FIG. 14. The shaft 83 is mounted in corresponding bearings at the ends of the card. Due to the helical construction of the brush 58, empty zones 86 occur between the individual rows of bristles.

FIG. 15 is a side view of a casing of a suction-extraction means 35 specially for use with the brush in FIG. 14. Instead of showing the chains 29, 31, a broken line in FIG. 15 simply indicates the path of the chain. As in the previous Figs. the chains rotate in the direction indicated by arrow 32. For simplicity also, a single flat 28 is shown in FIG. 15, but of course the chains can carry a number of flats. The casing of the suction-extraction means is divided into three different suction zones. A suction opening 88 is disposed directly behind the front edge 52 and sucks away the strips loosened by the comb (not shown). The rotatable brush 58 is disposed in a chamber which closely surrounds the brush 58 and has a suction opening 89 at the top. A second suction opening 91 is formed on the side of the brush 58 remote from the suction opening 88 and is adapted to suck away the particles of dirt which are loosened by the brush 58 but are still in the flats 28. Broken lines 92, 93 denote baffle plates disposed inside the suction-extraction mean 35 and adapted to guide the streams of suction air inside the casing and to guide all the suction-extracted dirt particles and fibers so that they are reliably sucked through the spigot 43 and cannot fall out e.g. through the opening 89.

A stationary card clothing 94 is disposed inside the casing of the suction-extraction means 35 and scratches dirt and fiber out of the strips of bristles 84 on the brush 58. At the moment when the card clothing 94 reaches a bristle-free zone 86, the tipped-out dirt particles are freed from the brush 58 and extracted by suction through the opening 89 and spigot 43.

FIG. 15 also shows how the suction-extraction means 35 is guided and driven during travel. The casing of means 35 is mounted on a slide 95 bearing four grooved rollers 96, only two of which are visible in FIG. 15. The other two are behind the grooved rollers shown in FIG. 15. The grooved rollers 96 are rotatably mounted on journals 97 borne by slide 95. Two guide rails 98 having a V cross-section are disposed above and below the grooved rollers. The two parallel spaced-apart guide rails 98 extend over the entire width of the card between the ends thereof. Although rails 98 and rollers 96 would alone be sufficient to guide the suction-extraction means 35, an additional guide device is provided in the form of a guide surface 99, which also extends between the two ends of the card, together with a roller 101 which moves on the guide surface 99 and is rotatably mounted on a journal 102 borne by the casing of the suction-extraction means. As FIG. 15 shows, a clearance is provided between the grooved rollers and the guide rails 99, as indicated by reference 103. As also shown, roller 101 and journal 102 are adjustable in the direction indicated by a double arrow 104. In this manner, the distance between the suction opening 88 and the flats or between the brush 58 and the flats can be very finely adjusted. The clearance 103 enables the adjustment to be made within a region determined by the geometrical conditions. The purpose of the four-roller arrangement is to prevent the means 35 from tilting in a plane at right angles to the plane of FIG. 15.

FIG. 15 also shows the drive for moving the suction-extraction means 35 in reciprocation. This drive comprises a rotating chain 105 driven by a chain wheel 106 at one end of the card and guided by a second chain wheel (not shown) at the other end of the card. A pin 107 is secured to a link of the chain and rotatably engages inside a corresponding opening in a cam 108. The cam 108 is rotatably mounted on an axle pin 109, secured to slide 95.

During operation, the suction-extraction means 35 is moved by the cam 108 to an end of the card until the suction-extraction means 35 strikes an abutment. The pin 107 then moves with the chain around the chain wheel associated with the aforementioned end, and the cam 108 simultaneously rotates around the pin 109 until the pin 109 and the chain begin the return motion and the suction-extraction means 35 is removed from the abutment and moves with the pin in the opposite direction.

The chain drive and the guide means in FIG. 15 can also be used if required in the other embodiments.

The invention thus provides a relatively simple flat cleaning apparatus which is able to reliably remove waste fibers and impurities from the flats of a revolving flat system in a card. In addition, the invention provides a flat cleaning apparatus which uses a relatively small amount of suction-extraction power.

What is claimed is:

1. A flat cleaning apparatus for a card comprising a comb for loosening waste fiber on the flats of a revolving flat system;

a suction-extraction means downstream of said comb relative to the direction of movement of the flats for for movement longitudinally across the flats of the revolving flat system, said means including at least one suction nozzle for drawing-in loosened waste fiber from the flats of the revolving flat system; and a rotatable brush in communication with said suction nozzle for extracting deep-seated dirt from between the flats of the revolving flat system.

2. An apparatus as set forth in claim 1 wherein said brush is disposed within said means and moves therewith across the flats.

3. An apparatus as set forth in claim 1 wherein said brush is of a length to extend across the flats and is stationary relative to said movable suction nozzle.

4. An apparatus as set forth in claim 1 wherein said means includes a casing having a partition subdividing said casing into said suction nozzle and a chamber containing said brush.

5. An apparatus as set forth in claim 1 wherein said brush is disposed downstream of said suction nozzle relative to said direction and remote from said comb.

6. An apparatus as set forth in claim 1 wherein said brush is movable towards and away from the flats.

7. An apparatus as set forth in claim 6 wherein said brush is periodically retracted from the flats.

8. An apparatus as set forth in claim 1 which further comprises means for rotating said brush in a selected one of two directions.

9. An apparatus as set forth in claim 1 wherein said suction-extraction-on means includes a chamber housing said brush and having a pair of walls extending in close proximity to opposite sides of said brush and narrowing to a location remote from said brush and a second suction nozzle communicating said chamber with said first suction nozzle.

10. An apparatus as set forth in claim 1 which further comprises a motor mounted on said suction extraction means and drivingly connected to said brush for rotating said brush.

11. An apparatus as set forth in claim 1 wherein said brush is mounted on a shaft of a length to extend across a card and comprising further comprising a motor for mounting on the card to drive said shaft.

12. An apparatus as set forth in claim 11 which further comprises a transmission drivingly connected between said shaft and said suction-extraction means for moving said means across a card.

13. An apparatus as set forth in claim 1 wherein said comb is pivotally mounted for oscillation relative to the flats of a revolving flat system.

14. An apparatus as set forth in claim 13 wherein said comb is movable perpendicularly of the flats.

15. An apparatus as set forth in claim 14 wherein said comb is movable in a sequence of movements from a starting position towards a travelling flat, then towards said suction-extraction means, then away from the travelling flat and then back to said starting position.

16. An apparatus as set forth in claim 1 wherein said suction-extraction means has a casing disposed about said brush and including a pair of suction nozzles on opposite sides of said brush for cleaning the flats.

17. An apparatus as set forth in claim 1 wherein said brush has at least one helically disposed brush strips.

18. An apparatus as set forth in claim 1 which further comprises a card clothing in said suction-extraction means for combing fibers from said brush.

19. A flat cleaning apparatus for a card comprising a comb for loosening waste fibers on the flats of a revolving flat system;

a casing having at least one suction nozzle downstream of said comb relative to the direction of movement of the flats for drawing-in loosed waste fiber from the flats and a chamber downstream of and in communication with said suction nozzle relative to said direction;

a rotatable brush downstream of said suction nozzle relative to said direction for extracting dirt from between the flats, at least part of said brush extending within said chamber to deliver extracted dirt to said suction nozzle within said casing; and means for moving said casing transversely of said comb longitudinally across the flats.

20. An apparatus as set forth in claim 19 wherein said brush is mounted in said casing for movement therewith.

21. An apparatus as set forth in claim 20 wherein said brush extends through said casing and is stationary relative to said casing.

22. An apparatus as set forth in claim 20 wherein said casing has a second suction duct downstream of said brush relative to said direction and in communication with said one suction duct.

23. In a card, the combination of a revolving flat system having a plurality of parallel flats having a clothing thereon;

a comb disposed above said system for loosening waste fibers on said flats;

a casing disposed above said system downstream of said comb relative to the direction of movement of the flats, said casing having at least one nozzle for drawing-in loosened fiber and dirt from said flats and a chamber downstream of and in communication with said suction nozzle relative to the direction of movement of the flats;

a rotatable brush for extracting dirt from between said flats and having at least one part extending within said chamber to deliver extracted fiber and dirt to said suction nozzle within said casing; and means for moving said casing across said system longitudinally of said flats.

24. The combination as set forth in claim 23 wherein said suction nozzle is of a length sufficient to subject each respective flat to suction as said casing moves longitudinally across the length of said respective flat.

25. The combination as set forth in claim 23 wherein said means includes an endless chain and a cam secured between said chain and said casing for reciprocating said casing across said revolving system.

26. The combination as set forth in claim 23 which further comprises a slide secured to said casing, a pair of guide rails extending across said revolving system and grooved rollers mounted on said slide and rollably mounted on said rails for guiding said casing therealong.

27. The combination as set forth in claim 26 wherein said rollers are spaced from said guide rails and further comprising third roller mounted on said casing and a guide extending parallel to said guide rails to receive said third roller thereon, each of said third roller and guide surface being adjustable relative to said revolving system to adjust the distance between said brush and said flats.

28. A flat cleaning apparatus for a card comprising a comb for loosening waste fiber on the flats of a revolving flat system;

a suction-extraction means downstream of said comb relative to the direction of movement of the flats for movement longitudinally across the flats of the revolving flat system, said means including at least one suction nozzle for drawing-in loosened waste fiber from the flats of the revolving flat system; and a brush disposed in said means for movement therewith across the flats, said brush being in communication with said suction nozzle for extracting deep-seated dirt from between the flats of the revolving flat system while being stationary relative to said movable suction nozzle.

29. An apparatus as set forth in claim 28 wherein said means includes a casing having a partition sub-dividing said casing into said suction nozzle and a chamber containing said brush.

30. An apparatus as set forth in claim 28 wherein said brush is disposed downstream of said suction nozzle and remote from said comb.

31. An apparatus as set forth in claim 28 wherein said brush is a rotatable brush.

32. An apparatus as set forth in claim 31 wherein said brush is movable towards and away from the flats.

33. An apparatus as set forth in claim 31 which further comprises a motor mounted on said suction extraction means and drivingly connected to said brush for rotating said brush.

34. An apparatus as set forth in claim 31 wherein said brush is mounted on a shaft of a length to extend across a card and further comprising a motor for mounting on the card to drive said shaft.

35. An apparatus as set forth in claim 34 which further comprises a transmission drivingly connected between said shaft and said suction-extraction means for moving said means across a card.

36. An apparatus as set forth in claim 28 wherein said comb is pivotally mounted for oscillation relative to the flats of a revolving flat system.

37. An apparatus as set forth in claim 28 wherein said suction-extraction means has a casing disposed about said brush and including a pair of suction nozzles on opposite sides of said brush for cleaning the flats.

38. An apparatus as set forth in claim 28 wherein said brush has at least one helically disposed brush strip.

39. An apparatus as set forth in claim 28 which further comprises a card clothing in said suction-extraction means for combing fibers from said brush.

* * * * *

UNITED STATES PATENT AND TRADEMARK OFFICE

CERTIFICATE OF CORRECTION

PATENT NO. : 4,996,746

DATED : MARCH 5, 1991

INVENTOR(S) : GIUSEPPE VERZILLI, et al

It is certified that error appears in the above-identified patent and that said Letters Patent is hereby corrected as shown below:

Column 4, line 23 change "Fig." to -Fig. 14-
Column 8, line 27 change "mean" to -means-
Column 9, line 34 change "for for" to -for-
Column 10, line 7 change "and comprising to -and-
Column 10, line 28 change "strips." to -strip.-
Column 10, line 66 change "nozzle" to -suction nozzle-
Column 11, line 24 change "third" to -a third-
Column 11, line 25 change "guide" to -guide surface-

Signed and Sealed this

Eighth Day of September, 1992

*Attest:*

DOUGLAS B. COMER

*Attesting Officer*

*Acting Commissioner of Patents and Trademarks*